US011505993B2

(12) United States Patent
de Vries et al.

(10) Patent No.: US 11,505,993 B2
(45) Date of Patent: Nov. 22, 2022

(54) UNIVERSAL OPERATING DEVICE FOR A SCREEN, SUCH AS A WINDOW COVERING

(71) Applicant: Coulisse B.V., Enter (NL)

(72) Inventors: Ruben Hubert Jan de Vries, Zevenaar (NL); Bastiaan Franciscus Klein Tuente, Groenlo (NL); Harry Davids, Utrecht (NL); Wouter Hendriks, Enschede (NL); Thomas Johan Maria Ter Haar, Hengelo (NL)

(73) Assignee: Coulisse B.V., Enter (NL)

( * ) Notice: Subject to any disclaimer, the term of this patent is extended or adjusted under 35 U.S.C. 154(b) by 138 days.

(21) Appl. No.: 16/948,035

(22) Filed: Aug. 28, 2020

(65) Prior Publication Data

US 2020/0392786 A1 Dec. 17, 2020

Related U.S. Application Data

(63) Continuation of application No. 15/782,083, filed on Oct. 12, 2017, now abandoned.

(30) Foreign Application Priority Data

Oct. 17, 2016 (NL) ..... 2017627

(51) Int. Cl.

| | |
|---|---|
| ***E06B 9/78*** | (2006.01) |
| ***E06B 9/326*** | (2006.01) |
| ***E06B 9/42*** | (2006.01) |

(52) U.S. Cl.

CPC ..... *E06B 9/78* (2013.01); *E06B 9/326* (2013.01); *E06B 9/42* (2013.01); *E06B 2009/3265* (2013.01); *E06B 2009/785* (2013.01)

(58) Field of Classification Search

CPC ... E06B 9/78; E06B 9/326; E06B 9/42; E06B 2009/3265; E06B 2009/785

See application file for complete search history.

(56) References Cited

U.S. PATENT DOCUMENTS 5,890,529 A 4/1999 Haarer
7,128,126 B2 * 10/2006 Smith ..... E06B 9/34 160/84.05

(Continued)

FOREIGN PATENT DOCUMENTS

AU 2016222265 A1 * 8/2017 ..... E06B 9/42
AU 2020218005 A1 * 8/2021

(Continued)

OTHER PUBLICATIONS

Dutch Patent Office Search Report for application 2017629, dated Jul. 10, 2017.

*Primary Examiner* — Johnnie A. Shablack
*Assistant Examiner* — Matthew R. Shepherd
(74) *Attorney, Agent, or Firm* — Oppedahl Patent Law Firm LLC

(57) ABSTRACT

An operating device for a screen comprises: a first operating mechanism with a first operating element which is connected to a first movement transfer element connected by means of a first transmission to a drive element for a screen shaft. The first operating mechanism is configured to convert a linear movement of the first operating element to a rotational movement of the drive element for operating the screen shaft in a first rotational direction. The operating device further comprises a second operating mechanism comprising a second operating element which is connected to a second movement transfer element connected by means of a second transmission to the drive element. The second operating mechanism is configured to convert a linear movement of the second operating element to a rotational move- (Continued)

ment of the drive element for operating the screen shaft in a second rotational direction opposite to the first rotational direction.

20 Claims, 6 Drawing Sheets

(56) References Cited

U.S. PATENT DOCUMENTS

| | | | | |
|---|---|---|---|---|
| 9,435,154 | B2 | 9/2016 | Chen | |
| 9,482,049 | B2 | 11/2016 | Chen | |
| 9,790,738 | B2 | 10/2017 | Jung | |
| 2008/0121353 | A1 | 5/2008 | Detmer | |
| 2014/0083631 | A1 | 3/2014 | Huang | |
| 2016/0319596 | A1 | 11/2016 | Li | |
| 2017/0145744 | A1 | 5/2017 | Diamond | |
| 2017/0362892 | A1* | 12/2017 | Marzilli | E06B 9/56 |
| 2018/0044981 | A1 | 2/2018 | Wang | |
| 2018/0155982 | A1 | 6/2018 | Medikayala | |
| 2019/0112872 | A1 | 4/2019 | Hsu | |
| 2019/0162022 | A1 | 5/2019 | Geiger | |

FOREIGN PATENT DOCUMENTS

| | | | | |
|---|---|---|---|---|
| CA | 2823663 | A1 * | 7/2012 | E06B 9/42 |
| EP | 1455049 | B1 | 7/2009 | |
| KR | 101213794 | B1 | 12/2012 | |
| WO | WO2015057027 | A1 | 4/2015 | |

* cited by examiner

UNIVERSAL OPERATING DEVICE FOR A SCREEN, SUCH AS A WINDOW COVERING

The invention relates to an operating device for a screen, such as a window covering, which screen is provided with a screen shaft and a drive element for the screen shaft, comprising:

a first operating mechanism comprising a first operating element which is connected to a first movement transfer element connected by means of a first transmission to the drive element, wherein the first operating mechanism is configured to convert a linear movement of the first operating element to a first rotational movement of the drive element for operating the screen shaft in a first rotational direction (clockwise or counterclockwise).

BACKGROUND

An example of such a known operating device is a chain operation with a chain loop or a cord loop with which the screen shaft can be rotated in two opposite directions in order to move a screen cover attached to the screen shaft upward or downward.

The present invention has for its object to improve the known operating device.

SUMMARY OF THE INVENTION

According to the invention the operating device further comprises:

a second operating mechanism comprising a second operating element which is connected to a second movement transfer element connected by means of a second transmission to the drive element, wherein the second operating mechanism is configured to convert a linear movement of the second operating element to a second rotational movement of the drive element for operating the screen shaft in a second rotational direction opposite to the first rotational direction (counterclockwise or clockwise).

The operating device according to the invention has various advantages. Firstly, the two operating elements can be embodied independently of each other. They no longer form part of a loop, whereby the operating device according to the invention is completely child-proof. The operation thereof is further highly intuitive for the user since a separate operating element is provided for upward and downward movement of the screen. The operating device according to the invention is moreover universally applicable as replacement for chain operation in diverse types of window covering. In the device according to the invention the first operating mechanism comprises a first pull cord and the first movement transfer element comprises a first cord reel for winding up the first pull cord, and the second operating mechanism comprises a second pull cord and the second movement transfer element comprises a second cord reel for winding up the second pull cord.

Cord reels provide the option of controlled operation in one direction.

An operating device according to the preamble of claim 1 is known from U.S. Pat. No. 5,890,529.

The operating device according to the invention is distinguished in that a spring is provided, preferably a recoil spring, which mutually connects the first pull cord and the second pull cord.

The shared (recoil) spring significantly contributes toward an exceptionally compact embodiment of the operating device. This has the direct consequence that, when it is mounted in a window covering, the width of a possible light gap will be as minimal as possible. Because of the narrow light gap the operating device according to the invention is universally applicable with diverse types of window covering, including roller blinds.

In a first preferred embodiment the first movement transfer element and the second movement transfer element are configured to enclose the spring. In this preferred embodiment the dimensions of the operating device according to the invention are minimal, this being particularly advantageous for application in a roller blind.

In a practical preferred embodiment the first movement transfer element is provided with a first collar and the second movement transfer element is provided with a second collar, wherein the spring is arranged between and connected to the first collar and the second collar.

In a further preferred embodiment the operating device comprises a housing with a passage for the central shaft in which the first movement transfer element and the second movement transfer element and the spring are accommodated. The two operating mechanisms of the operating device according to the invention can advantageously be accommodated in compact manner in a shared housing.

In a further elaboration the first transmission is provided with a first unidirectional coupling and a first toothed wheel on the drive element for co-action with the first unidirectional coupling in an operational position, wherein the first transmission is further provided with a first activator for activating the operational position of the unidirectional coupling, wherein the first movement transfer element is connected to the first activator, and the second transmission is provided with a second unidirectional coupling and a second toothed wheel on the drive element for co-action with the second unidirectional coupling in an operational position, wherein the second transmission is further provided with a second activator for activating the operational position of the second unidirectional coupling, wherein the second movement transfer element is connected to the second activator.

The operating device of U.S. Pat. No. 5,890,529 is likewise provided with such a first and second transmission. In the transmission according to U.S. Pat. No. 5,890,529 the movement transfer element pushes the unidirectional coupling in axial direction over the central shaft in engagement with the toothed wheel on the drive element. This results in a vulnerable transmission which is susceptible to wear and not suitable for heavy load, for instance of large screens.

The invention also provides an operating device with an improved first and second transmission, wherein the first unidirectional coupling is provided with a central first body with a first opening and a number of flexible first arms and wherein the second unidirectional coupling is provided with a central second body with a second opening and a number of flexible second arms. The first and second unidirectional couplings act in radial direction, this contributing toward a compact transmission.

The first activator is preferably provided with a first flange with a number of first protrusions for bending the first arms outward in radial direction of the first unidirectional coupling and the second activator is provided with a second flange with a number of second protrusions for bending the second arms outward in radial direction of the second unidirectional coupling. The activator likewise acts in radial direction, this further contributing toward a compact transmission with a minimal number of components.

In a further elaboration each of the protrusions is provided with a securing element which extends in peripheral direction of the flange for the purpose of locking one of the flexible arms. The securing elements ensure deactivation of the unidirectional coupling when it is not active.

According to a subsequent preferred embodiment, the drive element is provided on the inner side with the first and the second toothed wheel. This further contributes toward a compact embodiment of the operating device.

In a cost-efficient variant the first and the second toothed wheel are formed by one toothed wheel with straight toothing. This variant is simpler to produce.

In a practical preferred embodiment the first unidirectional coupling is arranged round a connecting bush for the drive element, which connecting bush is arranged on the central shaft.

In an elegant preferred embodiment the second unidirectional coupling is arranged round a collar around the passage of the housing.

In a compact preferred embodiment the first activator and the second activator are arranged coaxially round the central shaft in the passage of the housing.

The invention also relates to a screen, such as a window covering, provided with an operating device according to the invention.

DESCRIPTION OF THE DRAWING

The invention will now be described in more detail with reference to the figures.

DETAILED DESCRIPTION

Figure 1:
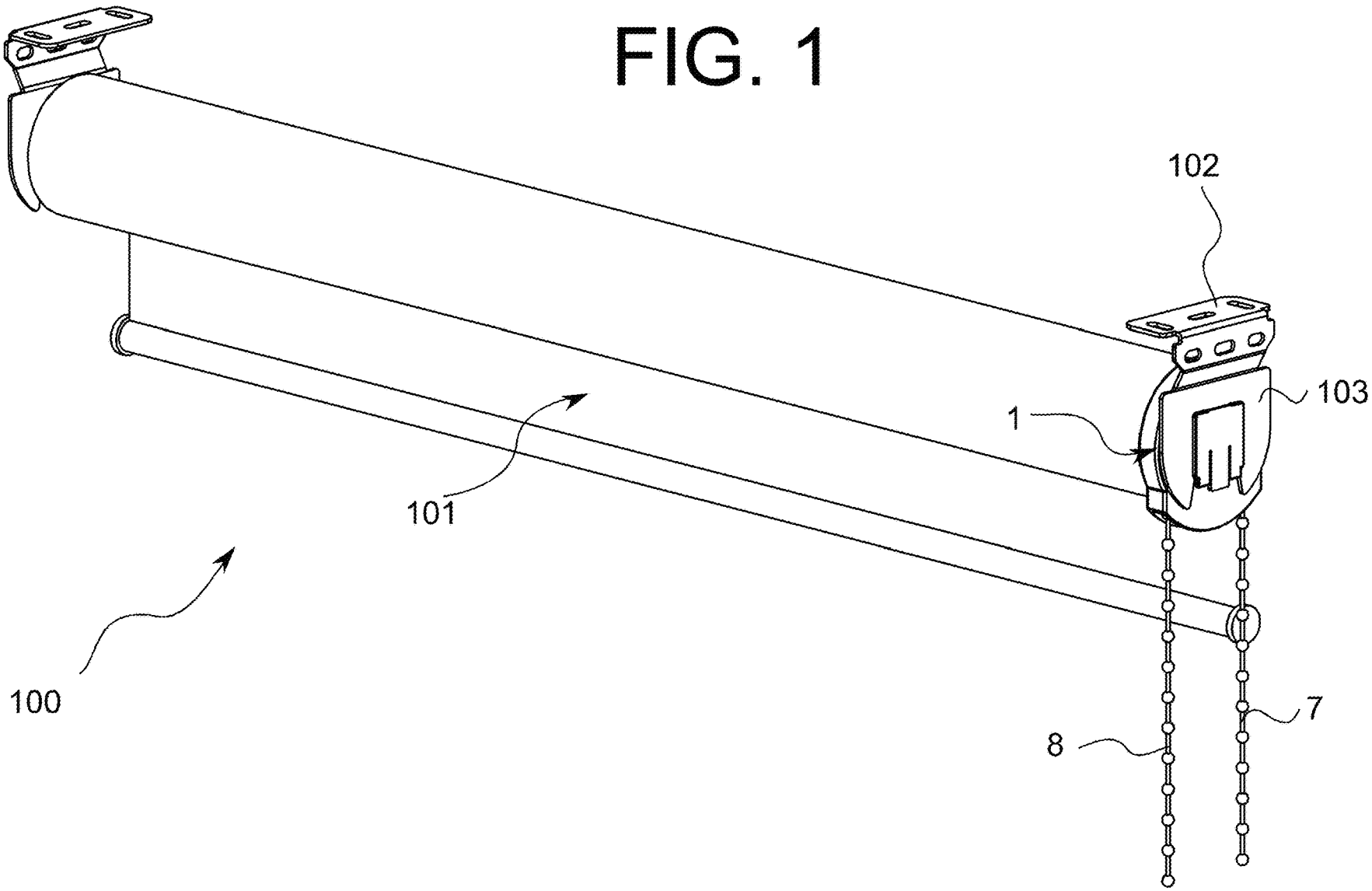
FIG. 1 is a schematic view of a roller blind with an operating device according to the invention.

FIG. 1 is a schematic view of a window covering 100 with an operating device 1 according to the invention. In the shown preferred embodiment the window covering is a roller blind system 100 provided with a flexible sheet-like object 101 such as a roller blind fabric or a screen covering which a user, using operating device 1, can wind up and unwind round a roller blind tube (not shown) with operating elements 7 and 8. The roller blind is further provided with two bracket holders or screen shaft holders 103 which are arranged on the outer ends of the roller blind system and are configured for releasable coupling to mounting brackets 102 for the purpose of mounting the roller blind system on a surface. Shaft holder 103 is provided with a connecting piece or pin 104 for connection to a screen shaft (not shown) of roller blind system 100. In roller blind system 100 the pin 104 and the screen shaft lie mutually in line along a central axis.

Figure 2:
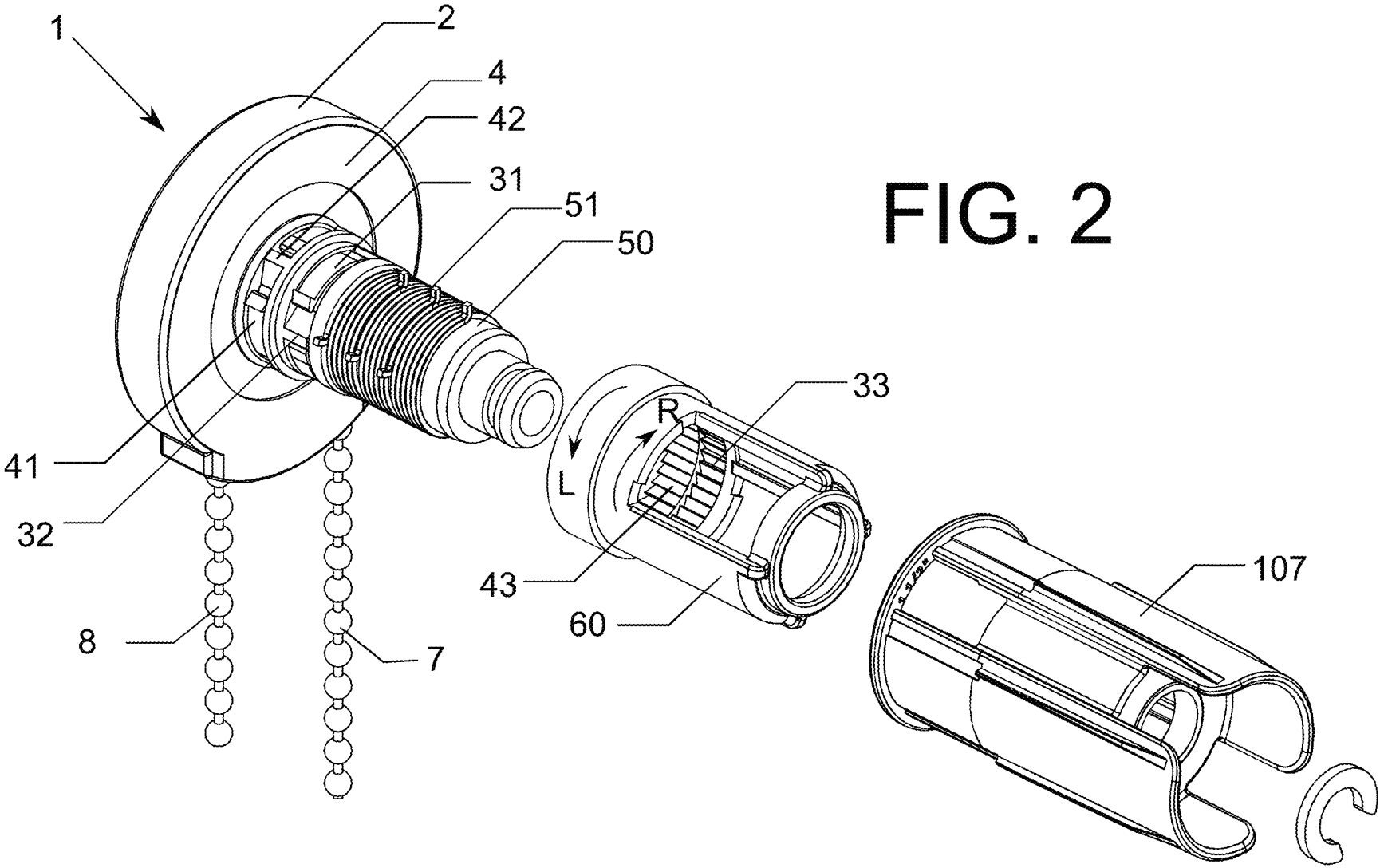
FIG. 2 shows the operating device of FIG. 1 in more detail.
Figure 3:
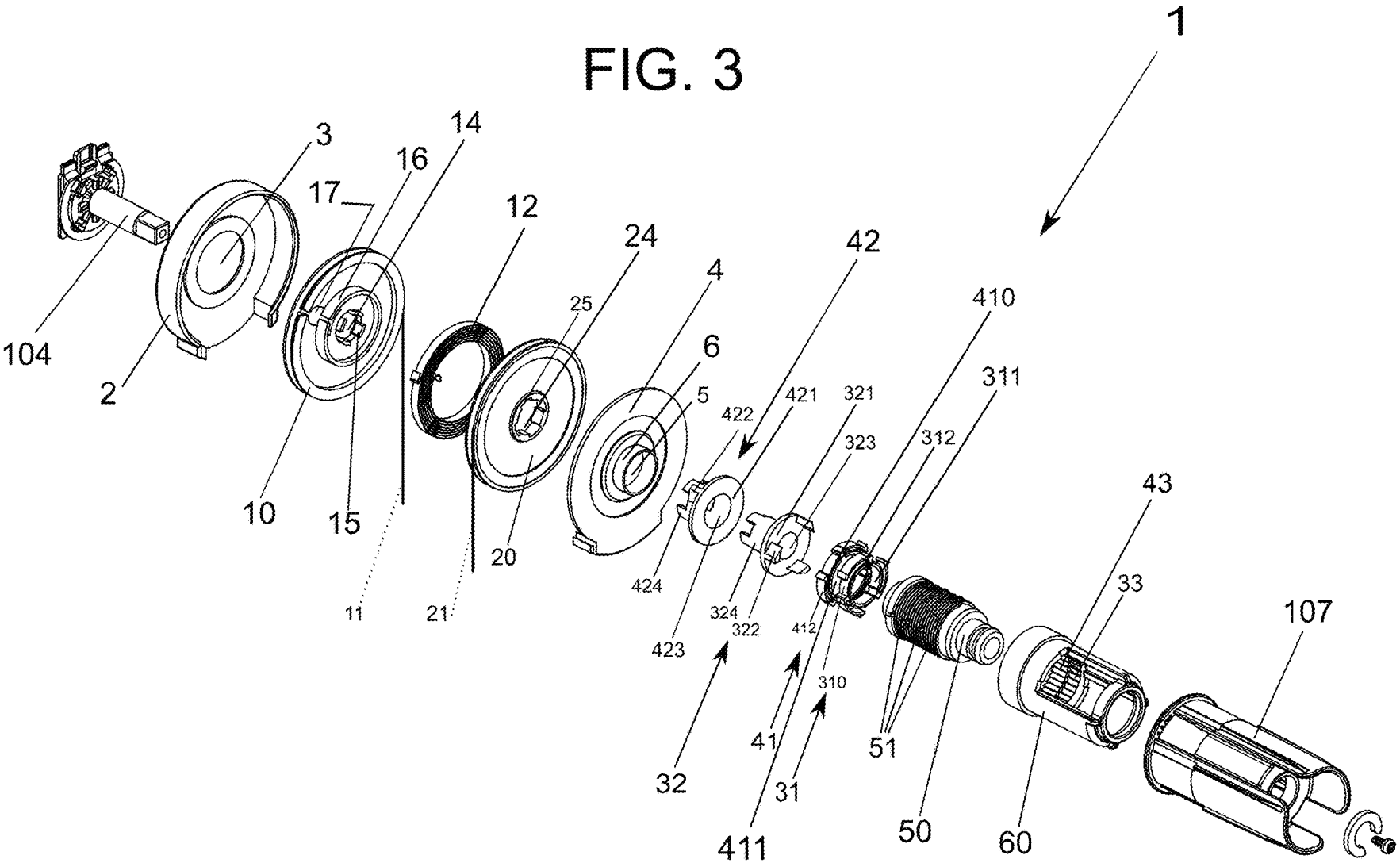
FIG. 3 shows the operating device of FIG. 2 with exploded parts.

FIG. 2 shows operating device 1 in more detail. FIG. 3 shows operating device 1 with exploded parts.

Operating device 1 according to the invention comprises two operating mechanisms. Each operating mechanism has its own respective operating element 7, 8 which is connected to a respective movement transfer element 10, 20. Both movement transfer elements 10, 20 are received in a housing comprising two housing parts 2, 4. First housing part 2 has a central passage 3, second housing part 4 has a central passage 5, first movement transfer element 10 has a central passage 14 and second movement transfer element 20 has a central passage 24 for the purpose of connecting the screen shaft to pin 104 of screen shaft holder 103.

Each movement transfer element is connected by means of an associated transmission to a drive element 60. The first operating mechanism is configured to convert a linear movement of first operating element 7 to a rotational movement of drive element 60 in clockwise direction. The second operating mechanism is configured to convert a linear movement of second operating element 8 to a rotational movement of drive element 60 in counterclockwise direction.

The first transmission is provided with a first unidirectional coupling 31 and a first toothed wheel 33 on drive element 60 for co-action with first unidirectional coupling 31 in an operational position. The first transmission is further provided with a first activator 32 for activating the operational position of unidirectional coupling 31. First activator 32 is connected to first movement transfer element 10.

The second transmission 40 is provided with a second unidirectional coupling 41 and a second toothed wheel 43 on drive element 60 for co-action with second unidirectional coupling 41 in an operational position. The second transmission is further provided with a second activator 42 for activating the operational position of second unidirectional coupling 41. Second activator 42 is connected to second movement transfer element 20.

First activator 32 and second activator 42 are arranged coaxially round pin 104 in the passage of housing 2, 3.

First unidirectional coupling 31 has a central first body 310 with a first opening 311 and a number of flexible first arms 312.

Second unidirectional coupling 41 has a central second body 410 with a second opening 411 and a number of flexible second arms 412.

First activator 32 has a first flange 321 with a number of first protrusions 322 and a first passage 323 with a first neck 324. Neck 324 is provided with first projections for co-action with a discontinuous collar 15 around central passage 14 on first cord reel 10.

Second activator 42 has a second flange 421 with a number of second protrusions 422 and a second passage 423 with a second discontinuous collar 424 with second projections. The discontinuous collar is configured to be received in recesses 25 in passage 24 on second cord reel 20.

Operating device 1 comprises a connecting bush 50 for receiving in drive element 60, which connecting bush is arranged on pin 104. Arranged with braking effect round connecting bush 50 are a number of throttle springs 51. The number of throttle springs preferably lies between one and five, and is most preferably three.

First unidirectional coupling 31 is arranged clamping lightly round an outer end of connecting bush 50. Second housing part 4 is provided with an external collar 6 round central passage 5. Second unidirectional coupling 41 is arranged clamping lightly round collar 6. First toothed wheel 33 and second toothed wheel 43 are arranged adjacently on the inner side of drive element 60.

Drive element 60 is configured for co-action with an end plug 107 intended to be received in a roller blind tube of roller blind system 100.

Housing 2, 4 is rotatable and so is not dependent on the direction of installation.

The operating device according to the invention can be used for both left or right-hand operation for a window covering.

The operation of the operating mechanisms will be explained in more detail with reference to FIGS. 4A, 4B, 5A and 5B.

In the shown preferred embodiment the first operating mechanism comprises a first pull cord 11 and the first movement transfer element is a first cord reel 10 for winding up the first pull cord 11.

In the shown preferred embodiment the second operating mechanism comprises a second pull cord 21 and the second movement transfer element is a second cord reel 10 for winding up the second pull cord 21.

First pull cord 11 and second pull cord 21 are mutually connected by a spring, preferably a recoil spring 12. This recoil spring 12 is shown in FIGS. 4A and 4B.

Figure 4A:
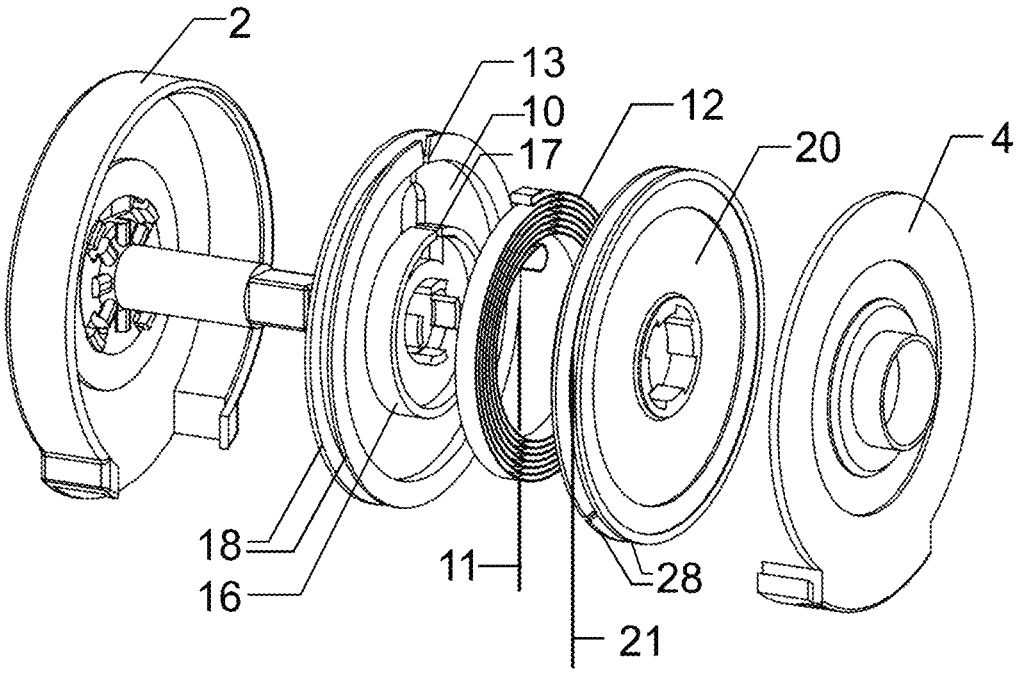
FIG. 4A shows a part of FIG. 2 in more detail.
Figure 4B:
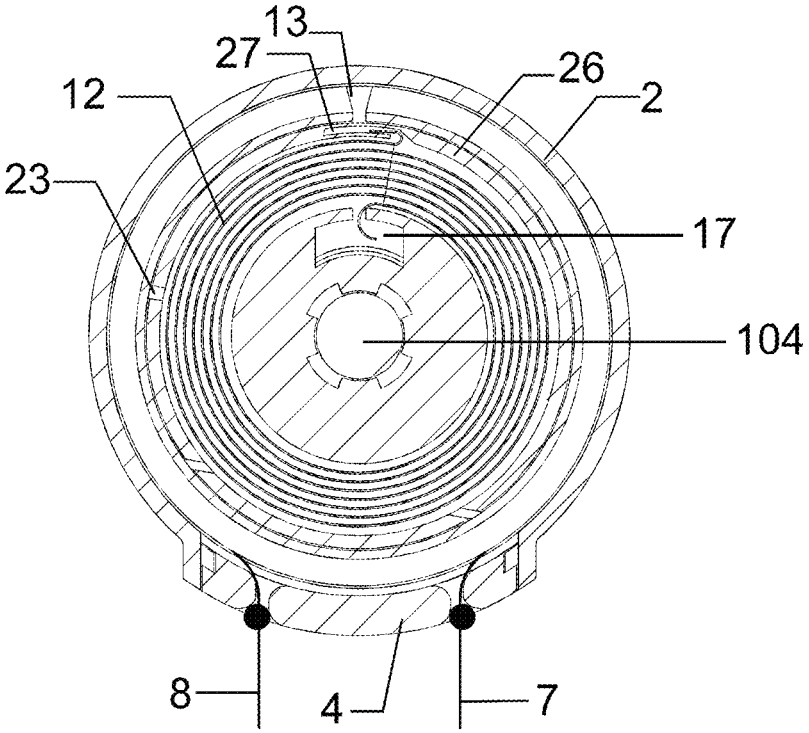
FIG. 4B is a cross-sectional view of a part of FIG. 2.

FIG. 4A shows a part of operating device 1 in more detail. FIG. 4B is a cross-sectional view of housing 2, 4 of operating device 1. Cord reel 10 is configured to guide first pull cord 11 along the periphery. In the shown preferred embodiment the first cord reel 10 is provided with a first peripheral edge 18 with a first outer cord passage 13 for attaching the first pull cord 11. First cord reel 10 is also provided with a first collar 16 with a first inner channel 17. Recoil spring 12 is placed between first collar 16 and first peripheral edge 18. The outer ends of recoil spring 12 take a hook-like form and an outer end hooks into channel 17.

The other outer end of first pull cord 11 is connected to first operating element 7. Cord reel 10 is provided with a stop for first operating element 7 during winding up of first pull cord 11. In the shown preferred embodiment first operating element 7 is a bead chain and the narrowed cord passage on the underside of housing 4 functions as stop for the beads of bead chain 7.

The outer end of first pull cord 11 is connected to an outer end of recoil spring 12. In the shown preferred embodiment this connection is indirect, i.e. via cord reel 10.

Cord reel 20 is configured to guide second pull cord 21 along the periphery. In the shown preferred embodiment second cord reel 20 is provided with a second peripheral edge 28. Second cord reel 20 is also provided with a second collar 26 with a second recess 27. The other hook-like end of recoil spring 21 hooks into recess 27. Also situated in the second collar is a second outer cord passage 23 for passage of second pull cord 21.

The other end of pull cord 21 is connected to the second operating element. Cord reel 20 is provided with a stop for second operating element 8 during winding up of second pull cord 21. In the shown preferred embodiment second operating element 8 is a bead chain and the narrowed cord passage on the underside of housing 4 functions as stop for the beads of bead chain 8.

The outer end of second pull cord 21 is connected to an outer end of recoil spring 12. In the shown preferred embodiment this connection is indirect, i.e. via cord reel 20.

The operation of the transmissions will be explained in more detail with reference to FIGS. 5A and 5B.

Figure 5A:
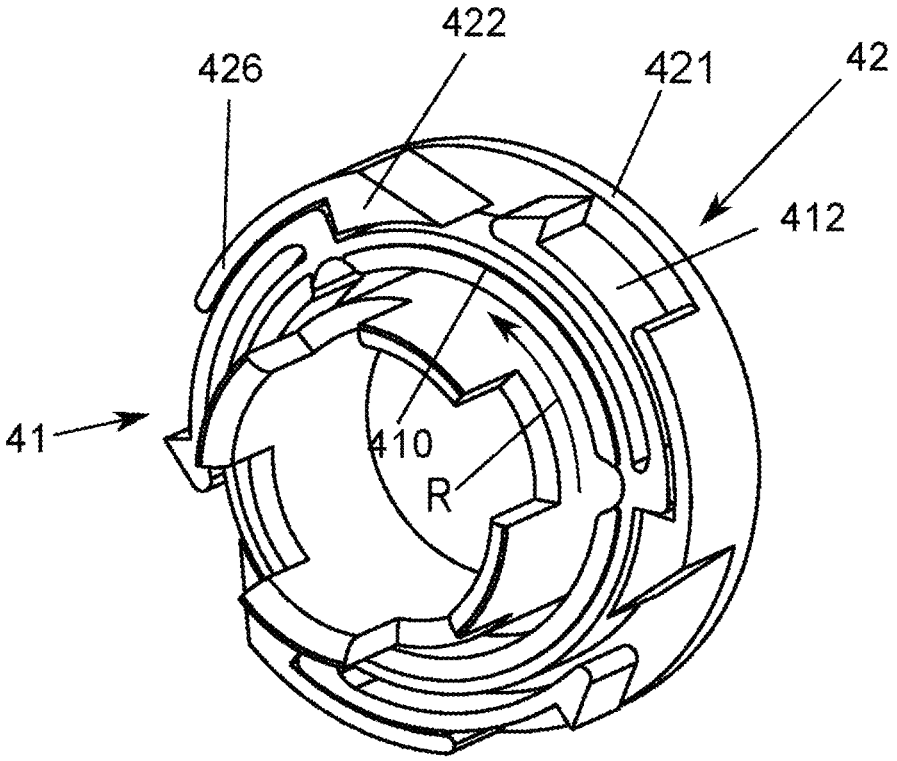
FIG. 5A is a cross-sectional view of another part of FIG. 2 in a first position.
Figure 5B:
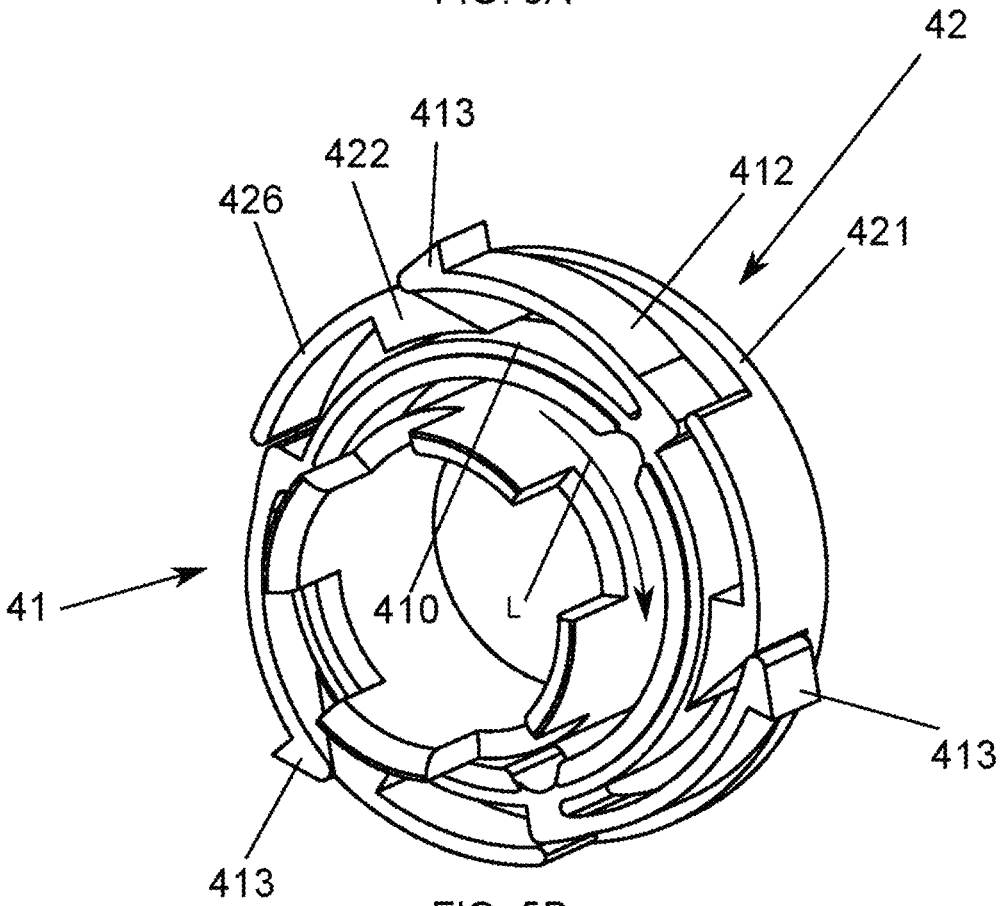
FIG. 5B is a cross-sectional view of the other part of FIG. 5A in a second position.

FIG. 5A is a schematic view with a variant of the transmission in a first position or rest position, and FIG. 5B is a schematic view of the transmission of FIG. 5A in a second position or operational position.

In the variant of the transmission the second unidirectional coupling of FIG. 3 is shown with a variant of activator 42. Each of the protrusions 422 is provided with a securing element 426 extending in peripheral direction of flange 421.

When operating element 8 is operated in counterclockwise direction (arrow L), each protrusion 422 slides under the nearby arm 412 and forces it to bend outward in radial direction of unidirectional coupling 41. Hooks 413 engage in toothed wheel 43, as a result of which drive element 60 co-rotates in counterclockwise direction.

When operating element 8 is no longer being operated by the user, recoil spring 12 ensures that activator 42 moves in clockwise direction (arrow R). As a result each securing element 426 slides partially over and locks the nearby arm 412. Drive element 60 can rotate freely round unidirectional coupling 41.

It is noted that the number of arms of the unidirectional coupling can vary, preferably between two and four. The number of protrusions of the activator has to be the same. The securing element or locking element on the protrusion of the activator is optional. Although the variant of FIG. 5A and FIG. 5B is illustrated only on the basis of second activator 42, it is likewise suitable for first activator 32. In addition to the shown unidirectional coupling, which is based on a ratchet-pawl mechanism, alternative unidirectional couplings are further available in the relevant field, such as a throttle spring.

Figure 6:
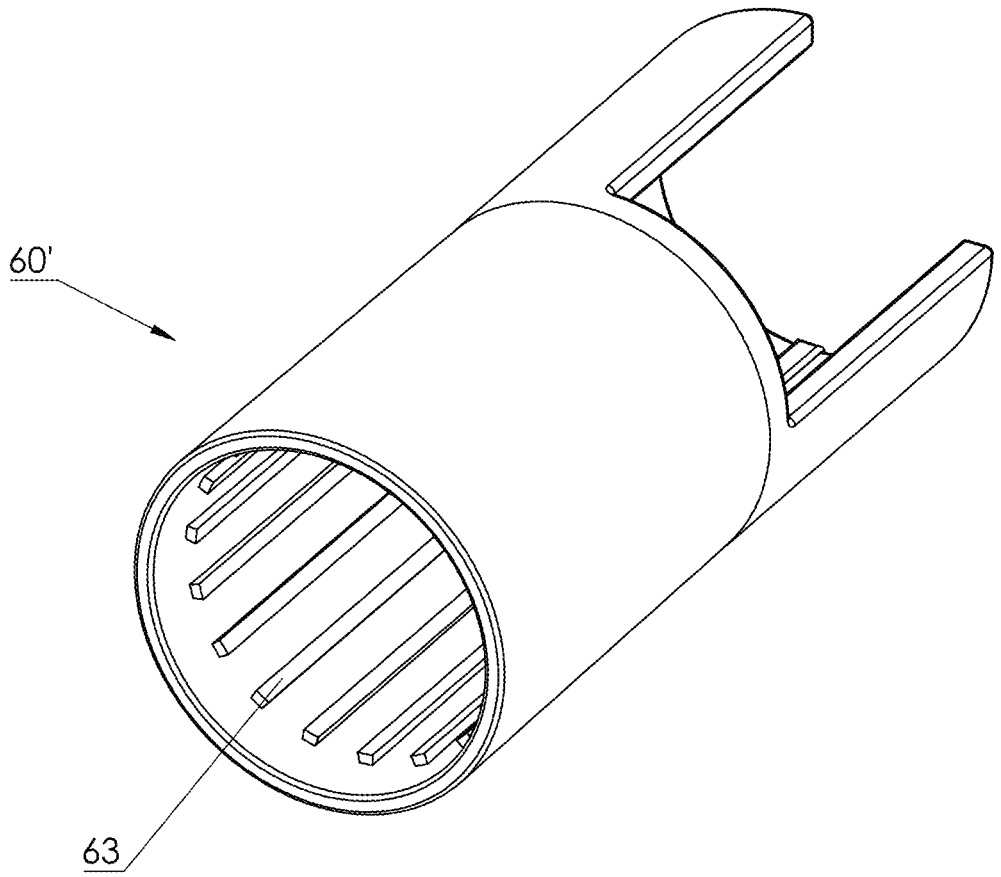
FIG. 6 shows a variant of the drive element in the operating device of FIGS. 2 and 3.

FIG. 6 shows a variant of the drive element in the operating device of FIGS. 2 and 3. Drive element 60' is provided with a straight toothing 63 for co-action with the first unidirectional coupling 31 and second unidirectional coupling 41.

Although the operating device according to the invention has been elucidated on the basis of a roller blind system, it will be apparent that the operating device is universally applicable with other types of window covering. A skilled person in the field will appreciate that this can be achieved by adapting the drive element for co-action with a type of plug other than the end plug for connection to the screen shaft of another type of window covering.

The invention is of course not therefore limited to the described and shown preferred embodiments but extends to any embodiment falling within the scope of protection as defined in the claims and as seen in the light of the foregoing description and accompanying drawings.

The invention claimed is:

1. An operating device for a screen, wherein the screen is provided with a screen shaft, said operating device comprising:

a drive element for the screen shaft, comprising:

a first operating mechanism comprising a first operating element wherein the first operating element is connected to a first movement transfer element connected by a first transmission to the drive element, wherein the first operating mechanism is configured to convert a linear movement of the first operating element to a rotational movement of the drive element for operating the screen shaft in a first rotational direction, a second operating mechanism comprising a second operating element wherein the second operating element is connected to a second movement transfer element connected by a second transmission to the drive element, wherein the second operating mechanism is configured to convert a linear movement of the second operating element to a rotational movement of the drive element for operating the screen shaft in a second rotational direction opposite to the first rotational direction, wherein the first operating mechanism comprises a first pull cord and the first movement transfer element comprises a first cord reel for winding up the first pull cord, wherein the second operating mechanism comprises a second pull cord and the second movement transfer element comprises a second cord reel for winding up the second pull cord, wherein the operating device comprises a recoil spring, wherein the recoil spring mutually connects the first pull cord and the second pull cord, wherein the first cord reel has a first central passage for a pin of a screen shaft holder and the first cord reel is provided with a first collar extending concentrically around the first central passage, wherein the second cord reel has a second central passage for the pin and the second cord reel is provided with a second collar extending concentrically around the second central passage, wherein the first cord reel and the second cord reel are arranged adjacently and completely enclose the recoil spring, wherein the recoil spring is arranged between the first collar and the second collar and a first end of the recoil spring is directly connected to the first collar and a second end of the recoil spring is directly connected the second collar.

2. The operating device as claimed in claim 1, wherein the first transmission is provided with a first unidirectional coupling and a first toothed wheel on the drive element for co-action with the first unidirectional coupling in an operational position, wherein the first transmission is further provided with a first activator for activating the operational position of the first unidirectional coupling, wherein the first cord reel is connected to the first activator, and wherein the second transmission is provided with a second unidirectional coupling and a second toothed wheel on the drive element for co-action with the second unidirectional coupling in an operational position, wherein the second transmission is further provided with a second activator for activating the operational position of the second unidirectional coupling, wherein the cord reel is connected to the second activator.

3. The operating device as claimed in claim 1, comprising a housing with a passage for connecting the screen shaft to the pin wherein the first cord reel and the second cord reel and the spring are accommodated in the housing.

4. The operating device as claimed in claim 2, wherein the first unidirectional coupling is provided with a central first body with a first opening and a number of flexible first arms and wherein the second unidirectional coupling is provided with a central second body with a second opening and a number of flexible second arms.

5. The operating device as claimed in claim 2, wherein the drive element is provided on an inner side with the first and second toothed wheels.

6. The operating device as claimed in claim 2, wherein the first unidirectional coupling is arranged around a connecting bush for the drive element, wherein the connecting bush is arranged on the pin.

7. The operating device as claimed in claim 2, comprising a housing with a passage for connecting the screen shaft to the pin wherein the first cord reel and the second cord reel and the spring are accommodated in the housing, wherein the second unidirectional coupling is arranged around a connecting bush for the drive element, wherein the connecting bush is arranged on the pin.

8. The operating device as claimed in claim 2, comprising a housing with a passage for connecting the screen shaft to the pin, wherein the first cord reel and the second cord reel and the spring are accommodated in the housing, wherein the first activator and the second activator are arranged coaxially around the screen shaft in the passage of the housing.

9. The operating device as claimed in claim 4, wherein the first activator is provided with a first flange with a number of first protrusions for bending the first arms outward in a radial direction of the first unidirectional coupling and wherein the second activator is provided with a second flange with a number of second protrusions for bending the second arms outward in a radial direction of the second unidirectional coupling.

10. The operating device as claimed in claim 5, wherein the first and second toothed wheels have a straight toothing and are arranged adjacently.

11. The operating device as claimed in claim 9, wherein each of the second protrusions is provided with a securing element, wherein the securing element extends in a peripheral direction of the second flange for locking one of the flexible second arms.

12. An operating device for a screen, wherein the screen is provided with a screen shaft, said operating device comprising: a drive element for the screen shaft:

a first operating mechanism comprising a first operating element, wherein the first operating element is connected to a first movement transfer element connected by a first transmission to the drive element, wherein the first operating mechanism is configured to convert a linear movement of the first operating element to a rotational movement of the drive element for operating the screen shaft in a first rotational direction, a second operating mechanism comprising a second operating element, wherein the second operating element is connected to a second movement transfer element connected by a second transmission to the drive element, wherein the second operating mechanism is configured to convert a linear movement of the second operating element to a rotational movement of the drive element for operating the screen shaft in a second rotational direction opposite to the first rotational direction, wherein the first transmission is provided with a first unidirectional coupling and a first toothed wheel on the drive element for co-action with the first unidirectional coupling in an operational position, wherein the second transmission is provided with a second unidirectional coupling and a second toothed wheel on the drive element for co-action with the second unidirectional coupling in an operational position, wherein the first transmission is further provided with a first activator for activating the operational position of the first unidirectional coupling, wherein the first movement transfer element is connected to the first activator, and wherein the second transmission is further provided with a second activator for activating the operational position of the second unidirectional coupling, wherein the second movement transfer element is connected to the second activator, wherein the first unidirectional coupling is provided with a central first body with a first opening and a number of flexible first arms and wherein the second unidirectional coupling is provided with a central second body with a second opening and a number of flexible second arms.

13. The operating device as claimed in claim 12, comprising a housing with a passage for connecting the screen shaft to a pin of a screen shaft holder, wherein the first movement transfer element and the second movement transfer element and the spring are accommodated in the housing.

14. The operating device as claimed in claim 12, wherein the drive element is provided on an inner side with the first and second toothed wheels.

15. The operating device as claimed in claim 12, wherein the first unidirectional coupling is arranged around a connecting bush for the drive element, wherein the connecting bush is arranged on a pin of a screen shaft holder.

16. The operating device as claimed in claim 14, wherein the first and second toothed wheels have a straight toothing and are arranged adjacently.

17. The operating device as claimed in claim 12, comprising a housing with a passage for connecting the screen shaft to a pin of a screen shaft holder, wherein the first movement transfer element and the second movement transfer element and the spring are accommodated in the housing, wherein the first activator and the second activator are arranged coaxially around the pin in the passage of the housing.

18. The operating device as claimed in claim 12, wherein the first activator is provided with a first flange with a number of first protrusions for bending the first arms outward in a radial direction of the first unidirectional coupling and wherein the second activator is provided with a second flange with a number of second protrusions for bending the second arms outward in a radial direction of the second unidirectional coupling.

19. The operating device as claimed in claim 12, comprising a housing with a passage for connecting the screen shaft to a pin of a screen shaft holder, wherein the first movement transfer element and the second movement transfer element and the spring are accommodated in the housing, wherein the second unidirectional coupling is arranged around a collar around the passage of the housing.

20. The operating device as claimed in claim 18, wherein each of the second protrusions is provided with a securing element, wherein the securing element extends in a peripheral direction of the second flange for the purpose of locking one of the second flexible arms.

* * * * *